United States Patent [19]

Meyer et al.

[11] Patent Number: 4,520,684

[45] Date of Patent: Jun. 4, 1985

[54] TAPE DRIVE CLOSURE OPERATOR

[75] Inventors: Lawrence L. Meyer, Canton; Alvin J. Carli, Sebring, both of Ohio

[73] Assignee: The Alliance Manufacturing Company, Inc., Alliance, Ohio

[21] Appl. No.: 463,591

[22] Filed: Feb. 3, 1983

[51] Int. Cl.[3] ..... F16H 27/02; F16H 29/02

[52] U.S. Cl. ..... 74/89.21; 474/205; 226/76

[58] Field of Search ..... 74/89.2, 89.21, 501 R; 474/204, 202, 205; 49/199, 352; 226/76, 89

[56] References Cited

U.S. PATENT DOCUMENTS

| | | | |
|---|---|---|---|
| 239,114 | 3/1881 | Reese | 474/205 X |
| 2,176,517 | 10/1939 | Wittel | 226/87 |
| 3,252,503 | 4/1964 | Jackson | 160/193 |
| 3,577,794 | 5/1971 | Kerfoot | 474/204 |
| 4,026,756 | 5/1977 | Stanfield et al. | 226/76 X |
| 4,311,225 | 1/1982 | Tsubaki et al. | 74/89.21 X |
| 4,316,567 | 2/1982 | Grear et al. | 226/87 X |
| 4,412,637 | 11/1983 | Berger | 226/76 X |
| 4,414,778 | 11/1983 | Carli | 74/89.21 X |

FOREIGN PATENT DOCUMENTS

| | | | |
|---|---|---|---|
| 568864 | 7/1958 | Belgium | 474/205 |
| 1068553 | 12/1956 | Fed. Rep. of Germany | 226/87 |
| 1113501 | 12/1955 | France | 474/205 |

*Primary Examiner*—George H. Krizmanich
*Assistant Examiner*—Dirk Wright
*Attorney, Agent, or Firm*—Pearne, Gordon, Sessions, McCoy, Granger & Tilberry

[57] ABSTRACT

A closure operator such as a garage door operator utilizes an apertured flexible tape. The tape is enclosed in a guide and a drive sprocket has teeth engaging the apertures to apply both tension and compression forces to open and close a door. The apertures are enlarged in width and length and the tape has fewer apertures per-unit-length compared to the prior art tape. This decreases the stress per-unit-area in the tape at each tooth and increases the shear strength of the webs between successive apertures to be more nearly equal to the tensile strength of the tension band areas of the tape.

12 Claims, 12 Drawing Figures

TAPE DRIVE CLOSURE OPERATOR

BACKGROUND OF THE INVENTION

Closure operators have been designed to actuate closures such as a garage door in opening and closing movements. Such door operators have utilized a continuous chain having one driven sprocket and one idler sprocket near opposite ends of a guideway for a slidable member connectable to the door to effect these opening and closing movements. Such door operators have usually had a reversible motor and in all cases the chain is loaded in tension for both opening and closing movements.

Another type of door operator includes a rotatable worm or screw rotating in an elongated guideway which also guides a slidable member connectable to the door, the slidable member carrying a partial nut engaging the screw so that upon motor drive rotation of the screw, the door is moved in opening or closing movements depending upon the rotational direction of the screw. The relatively rigid screw is made of metal and is loaded in tension and compression forces for opening and closing movements, respectively.

In the chain drive type of door operator, the guide channel for many years has been cut into two or three pieces for compactness of the shipping container and then spliced together end-to-end at the garage site for use. In recent years, the screw drive type of door operator has had the guide rail cut into two or three pieces and then spliced together at the garage site use. This, however, requires the screw to be also cut into two or three pieces and the joints between these screw sections can weaken the entire screw and door operator.

Another construction of a door operator is suggested in U.S. Pat. No. 3,252,503, wherein an elongated, flexible belt or tape is motor-driven by a worm gear engaging worm teeth apertures in the tape and the tape is guided in a rigid, elongated track which also guides a slidable member connectable to the door for opening and closing movements. The tape has two discrete ends rather than being a continuous loop, is loaded in tension for opening movements of the door, and is designed to be loaded in compression for closing movements. This patent shows the door operator in suggested use with a sectional garage door rolling on a track which is generally vertical at the closed position and generally horizontal at the open position of the door.

A deficiency in this type of tape drive door operator when it is actually constructed and attempted to be operated is that the flexible tape has limited strength both for tension forces during opening and compression forces during closing. Also for the door operator to be commercially marketable throughout the United States, it must meet UL requirements and be satisfactory for use with the great majority of garage doors, including not only the sectional doors riding on a curved track but also slab or one-piece doors which are currently prevalent in the west. A first type of slab door of one piece moves upwardly and outwardly to a position partially in and partially outside the garage as a canopy in a generally horizontal position. A second type of single slab type door is one which moves on hardware upwardly and inwardly to a position entirely within the garage into a generally horizontal attitude. To be commercially merchandised in the United States, both the screw drive and chain drive types of door operator must operate satisfactorily with at least these three different types of garage doors, and with such types in a full range of common door sizes. In either of these two types of slab doors, the load on the door operator is considerably greater than in a multiple sectional door rolling on a track, because in such sectional door the initial starting opening movement of the door is similar to breaking the knee of a toggle, which is a relatively small force, easy opening movement.

The flexible tapes commercially available for this suggested use as a garage door operator are tapes with punched holes for a drive sprocket rather than a worm gear, and such tapes have been used successfully in light-load applications such as window lift mechanisms in automobiles. However, such tape which is suitable for such light-load applications has been found to be unsatisfactory in life tests for garage door operators because the web between adjacent apertures is stripped or sheared from the tape at the drive sprocket.

SUMMARY OF THE INVENTION

The problem to be solved, therefore, is how to design and construct a closure operator usable as a garage door operator, wherein the above-mentioned deficiencies are overcome.

This problem is solved by a motor-driven closure operator having a flexible tape with a plurality of longitudinally aligned apertures to mesh with teeth on a motor-driven drive member, said tape adapted to be stressed longitudinally by movement of the drive member to actuate a closure, the improvement comprising means establishing the spacing and size of the apertures in said tape in accordance with the number of active teeth on the drive member engaging the tape to establish the shear strength of the webs between longitudinally adjacent active tooth apertures approaching the tensile strength of the tape at an aperture.

The problem is further solved by a closure operator having a motor-driven drive sprocket around part of which is disposed a flexible tape having a plurality of longitudinally aligned apertures, said tape adapted to be stressed longitudinally by both forward and reverse rotation of the drive sprocket to actuate a closure, the improvement comprising means establishing the spacing and size of the apertures in said tape such that the ratio of the width of the tape remaining at an aperture to the longitudinal distance between successive longitudinally aligned apertures is less than 3:1.

The problem is further solved by the method of increasing the load capacity of a flexible elastic belt having a plurality of longitudinally aligned and spaced apertures therein for engagement with teeth of a sprocket wheel, said belt having at least one longitudinal belt area disposed laterally of said longitudinally aligned apertures and having web areas disposed between successive longitudinally aligned apertures, said method comprising determining the tensile strength of said belt in said at least one longitudinal belt area, determining the shear strength of said belt between said web and said at least one longitudinal belt area, and adjusting the size and spacing of said apertures to make said two strengths more nearly equal.

An object of the invention is to provide a garage door operator using a flexible tape which will pass an actual life test.

Another object of the invention is to provide a closure operator suitable for use with one-piece garage door operators and utilizing a flexible tape drive.

A further object of the invention is to provide a closure operator suitable for a garage door operator wherein the webs between successive apertures in the flexible tape are considerably strengthened.

Other objects and a fuller understanding of the invention may be had by referring to the following description and claims, taken in conjunction with the accompanying drawing.

DESCRIPTION OF THE PREFERRED EMBODIMENT

Figures 1, 2, 3:
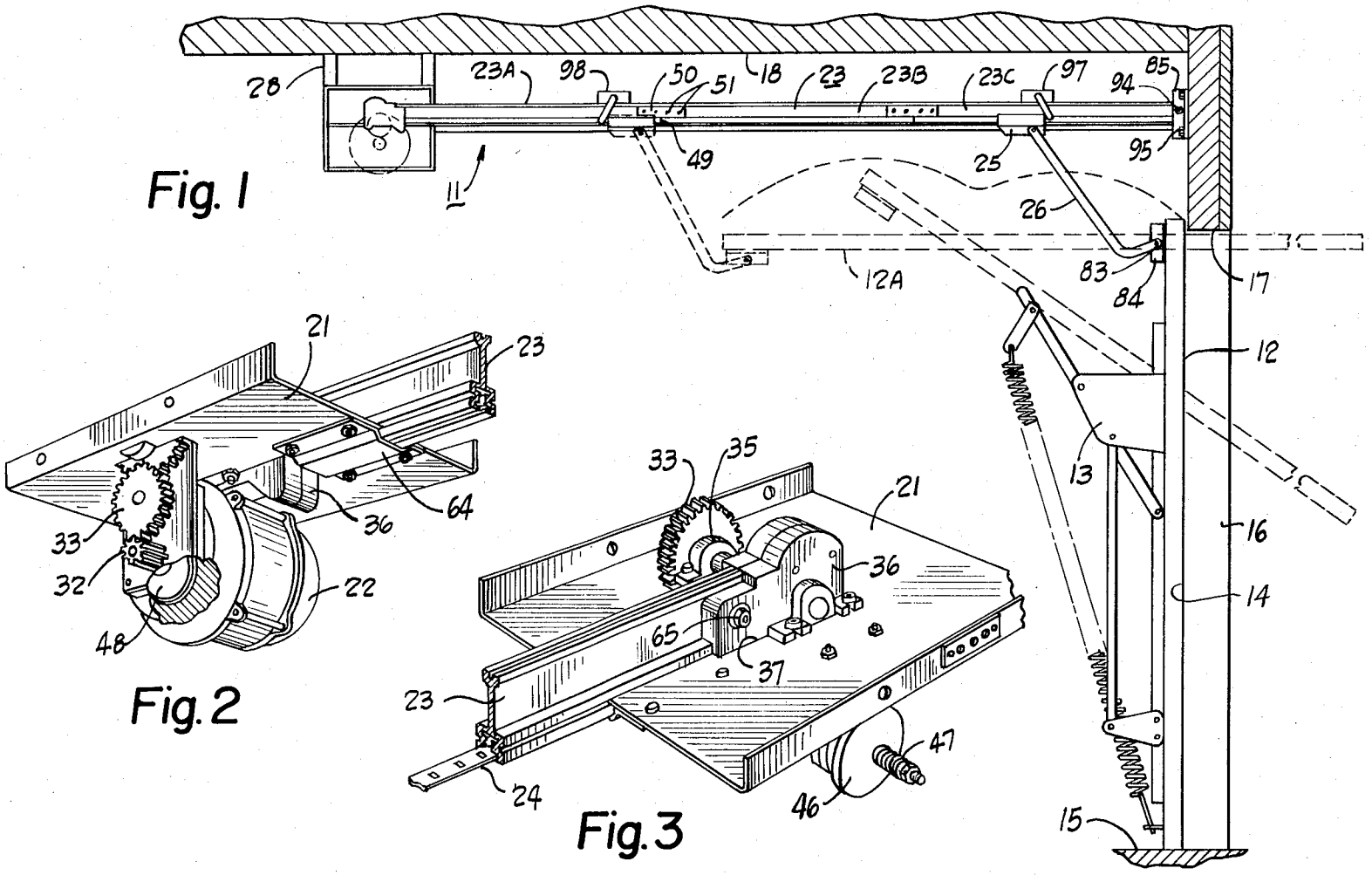
FIG. 1 is a side elevational view of a garage door constructed to be movable by a closure operator according to the invention.
FIG. 2 is a perspective view of the motor drive end of the door operator, with the cover removed.
FIG. 3 is a perspective view from the upper side of the motor drive end of the garage door operator.

The figures of the drawings show a closure operator constructed as a garage door operator 11 for use with a garage door 12, which may be an upward acting sectional door, but which is shown as a one-piece or slab door having a type of pivot hardware 13 fastened to the door jamb 14 movable from a closed position shown in solid lines to an open position 12A shown in dotted lines. When closed, the door 12 rests on a door sill 15 and closes a door frame opening 16, which opening has a door header 17, and the garage in which the door is used has a ceiling 18.

The garage door operator 11 includes generally a motor base 21, a motor 22 mounted on the base 21, guide rail means 23 which guides a flexible tape or belt 24, a carriage 25, and a link 26. The base 21 may be of sheet metal, and is adapted to be secured to the ceiling 18 of the garage by any suitable mounting support 28. The motor 22 is preferably an electric motor, and is connected in some manner to drive a drive wheel or drive sprocket 29, shown in FIG. 4. In the preferred embodiment, this drive connection is one wherein a motor 22 has a drive pinion 30 driving a gear 31 which is coaxial with and connected to a pinion 32 which meshes with and drives a gear 33. This gear 33 is fixed on a shaft 34 which is journaled in a bearing block 35 near one end of the shaft, and the other end of the shaft is journaled in a drive wheel housing 36. This drive wheel housing is mounted in an aperture of the base plate 21 to extend partly above and partly below this base plate. The housing 36 is also formed in two halves, split perpendicularly to the shaft 34, receiving one end of the guide rail means 23 between the halves. The drive wheel 29 is keyed on the shaft 34 and is disposed inside the housing 36.

The flexible tape 24 may be formed of Delrin or from Dymetrol, for example, which is a trademark of the E. I. DuPont de Nemours & Company for a family of EPS elastomeric polyesters. These tapes are extruded from a long-chain polymer so as to be flexible, resilient, somewhat elastic, and self-lubricating in the guide rail means 23.

A positive drive connection between the drive wheel 29 and flexible tape 24 is provided, the positive drive connection being formed by projections on either the tape or the wheel entering apertures on the other member. As shown in the preferred embodiment, the drive wheel 29 has projecting teeth 38 entering apertures 39 on the tape 24. The housing 36 includes walls 40 defining slots 41 and 42, which guide the tape 24 into first and second runs 43 and 44, respectively, and guide the tape around and into driving engagement with the drive wheel 29. Stripper teeth 41A and 42A are provided at the ends of the slots 41 and 42, respectively, to positively strip the tape from the drive sprocket teeth 38. The slots 41 and 42 guide the tape so that the tape has driving engagement in excess of 180 degrees with the drive wheel 29 and, as shown, this is preferably about 210 degrees of drive engagement.

The motor 22 may be provided with a safety clutch 46 urged into engagement by a clutch spring 47, and this clutch will slip upon overload, whereupon a safety switch (not shown) may be actuated to de-energize the motor 22. Upon de-energization of the motor, a brake 48 is automatically applied to the rotor of the motor 22. The guide rail means 23 is shown as being formed in three pieces 23A, 23B, and 23C, which are butted together at joints 49 and then spliced by means of splice plates 50 and fasteners such as bolts 51. There may be one splice plate at each joint 49, or there may be a pair of splice plates one on each side of the guide rail means 23. These three guide rail sections 23A, 23B, and 23C are normally shipped disassembled in order to achieve a shorter length of shipping carton, and are assembled end-to-end to make a complete guide rail assembly at the garage site.

Figure 4:
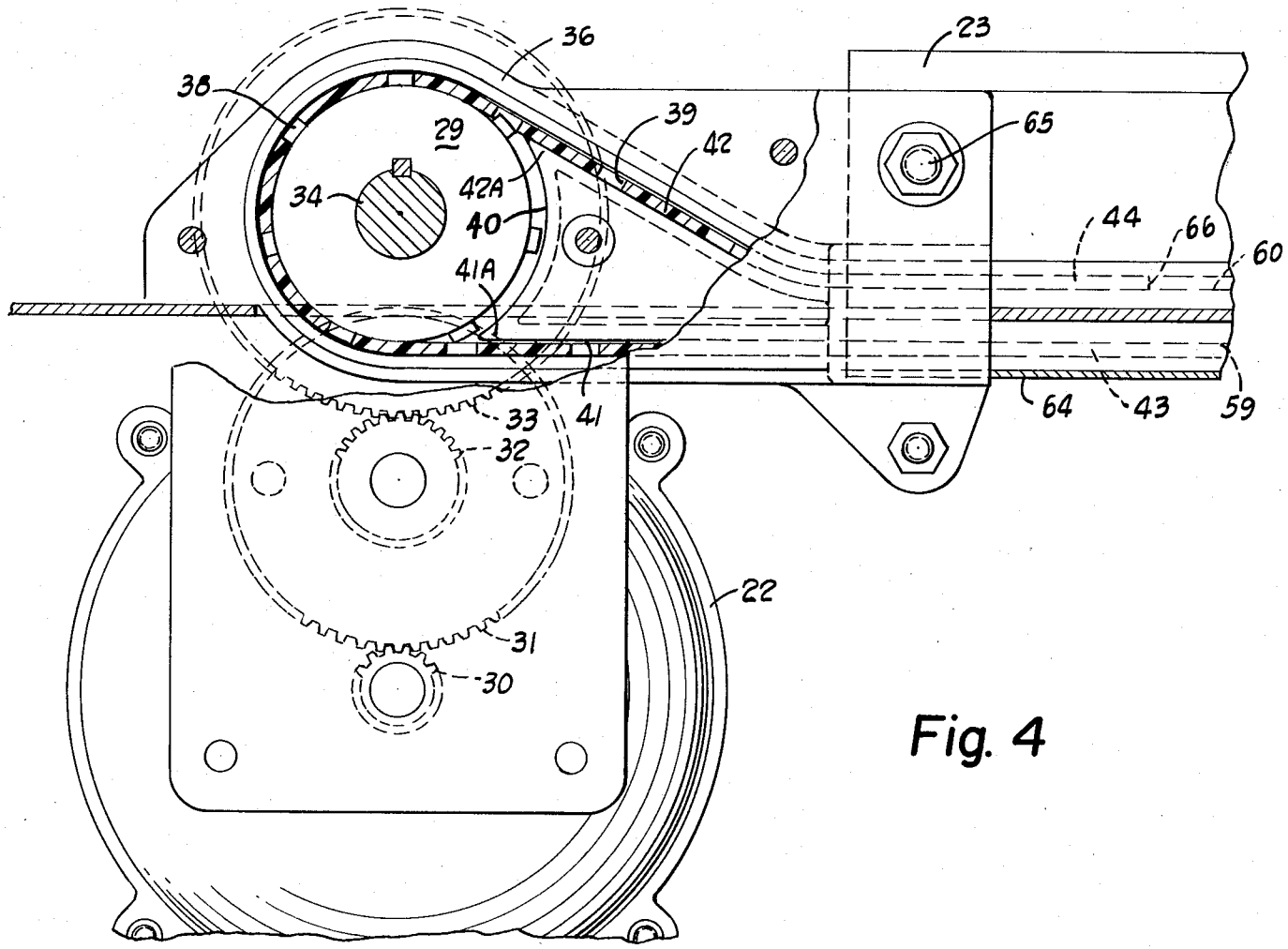
FIG. 4 is an enlarged, side elevational view of the motor drive end of the door operator, partially in section.
Figure 5:
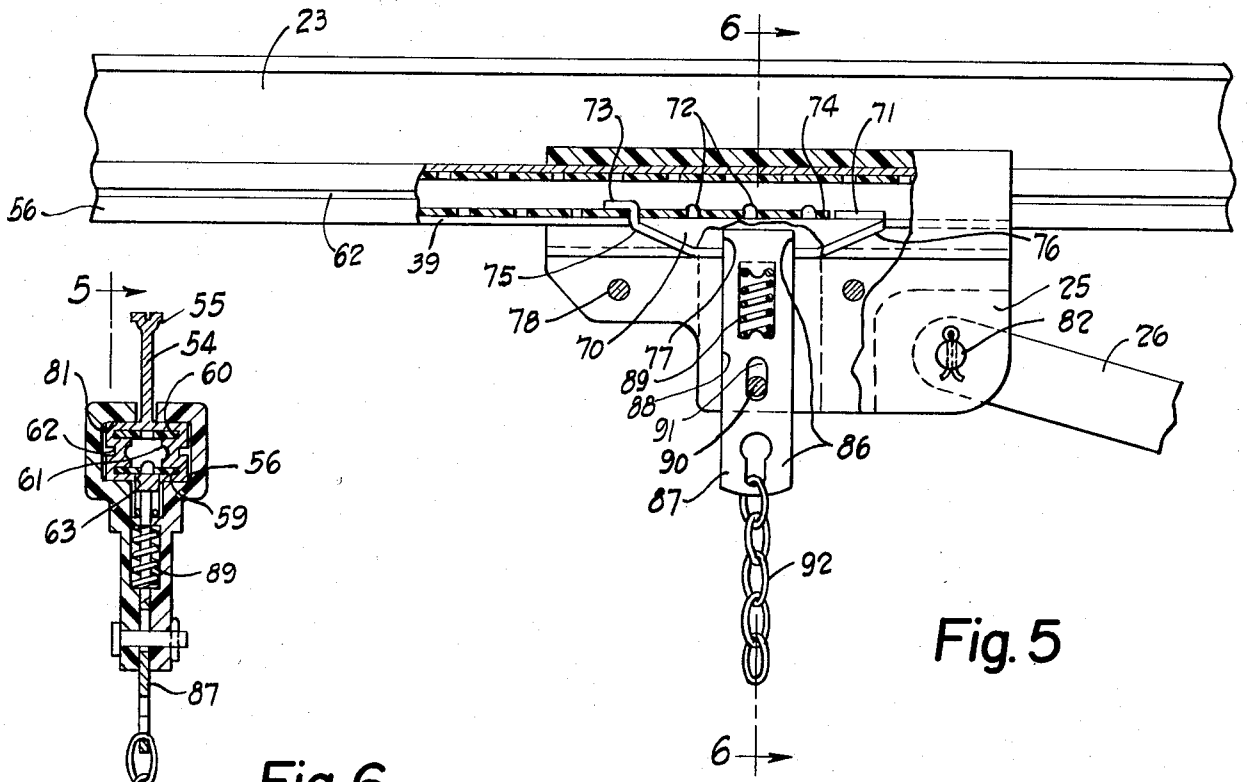
FIG. 5 is an enlarged, side elevational view of the carriage and rail assembly and partially in section.
Figure 6:
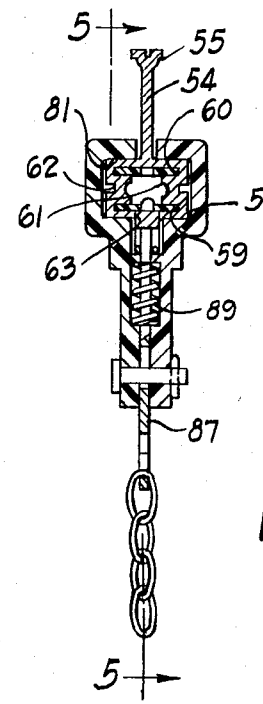
FIG. 6 is a sectional view on line 6—6 of FIG. 5.

FIGS. 4, 5, and 6 better illustrate the guide rail means 23, which has a thin web 54 interconnecting an upper flange 55 and a lower flange 56. The rail 23 may be of extruded aluminum, for example, to be a stiff, rigid member relative to the tape 24. Both of these flanges add stiffness to the guide rail means 23. The lower flange 56 is thickened in a vertical direction, as mounted, in order to provide first and second guide channels 59 and 60, respectively, with a wall 61 therebetween which defines generally an oval cross sectional open space. Centrally located longitudinally of the lower flange 56 are two opposite slots 62, and a lower slot 63 provides access to the first guide channel 59.

In FIGS. 3 and 4, it will be noted that the motor end of the guide rail means 23 enters the drive wheel housing aperture 37 in the motor base plate 21, with the base plate fitting within the slots 62 of the guide rail 23 in order to position the guide rail. A plate 64 is clamped to the base plate 21, and also a bolt 65 secures the motor end of the guide rail means 23 to the drive wheel housing 36.

FIGS. 5 and 6 better show the means of connecting the door operator 11 to the garage door 12. From FIG.

4, it will be noted that the first run 43 of tape 24 enters the lowermost or first guide channel 59, and the second run of tape 24 is guided to enter the uppermost or second guide channel 60.

In the position shown in FIG. 1, with the door 12 closed, the tape 24 has a length to reach the carriage 25, substantially filling the entire length of the first guide channel 59, and then it wraps around the drive wheel 29 and enters a short distance into the second guide channel 60, with the end of the second run 44 of the tape 24 being at about the location 66 in FIG. 4. Therefore, it will be seen that the tape 66 is not an endless piece of tape, but need be of a length only sufficient to lie along the length of the guide rail 23, with enough remaining to enter the second guide channel 60, which may be considered a storage guide channel.

FIGS. 5 and 6 illustrate a slide block 70 which may be made of a filled nylon, for example, to be self-lubricating. This slide block has a flange 71 which enters in and slides in the first guide channel 59. Projections 72 are provided on the upper surface of the slide block 70, plus a locking projection 73. The first run 43 of tape 24 has an end 74 close to the flange 78 and the apertures 39 in the tape 24 engage the projections 72 and the locking projection 73. Ramps 75 and 76 are provided on the lower surface of the slide block 70 on either side of a recess 77.

The carriage 25 is made of nylon, Delrin, or a glass-filled polyester resin to be self-lubricating relative to the guide rail means 23. The carriage 25 is made in two halves fastened together by rivets 78. The carriage 25 has a channel 81 disposed on the upper part thereof to embrace and slide along the lower flange 56 of the guide rail means 23. The link 26 is an L-shaped door arm which is pivoted by a pin 82 to the carriage 25 and the other end of this link 26 is pivoted by a pin 83 to a bracket 84 secured to the upper part of the door 12. As shown in FIG. 1, a bracket 85 secures the door end of the guide rail means 23 to the door frame header 17 to take the thrust of opening and closing of the door 12. The slide block 70 is interconnected with the carriage 25 by means of an interlock 86. This interlock includes a latch 87 and the recess 77. The latch 87 is disposed in a guide channel 88 in the carriage 25. A compression spring 89 urges the latch 87 upwardly toward engagement in the recess 77 and a cross pin 90 in a slot 91 limits the extent of movement of this latch 87. A pull chain 92 is connected to the lower end of the latch 87, and may be pulled to disengage the interlock 86.

FIG. 1 shows the garage door operator 11 as assembled. Initially, for shipping, the garage door operator would be shipped in a much shorter shipping carton. The three guide rail sections 23A, 23B, and 23C would be side-by-side in a shipping carton of only about 3 or 3½ feet in length. The flexible tape 24 preferably would be threaded through the drive wheel housing 36 with the lower, long end formed into a coil about six or eight inches in diameter. The motor, gear unit, and base plate would be preassembled and would determine the thickest part of the shipping carton.

To assemble the door operator 11, the splice plates 50 and fasteners 51 would be used to assemble the three sections of the guide rail into one elongated, rigid guide rail means 23. The door end bracket 85 would already be attached to one end of the guide rail means 23 by means of a pivot pin 94. The flexible tape would then be unrolled and the locking projection 73 inserted through the fourth aperture from the end 74 of the flexible tape 24. The flange 71 on the slide block 70 would then be inserted into the motor end of the guide rail 23, and this slide block 70 and the end 74 of the tape slid into this first guide channel 59 any desired amount, and preferably for about the entire length of this guide rail 23. The second end 66 of the tape would be already preassembled around the drive wheel 29 and extending a short distance out of the upper slot 42. It would be slid into the second guide channel 60 and the motor end of the guide rail means 23 could then be fastened in place of the base plate 21 by the clamp plate 64 and the bolt 65. The proper position on the door header 17 for the bracket 85 could be located, and this bracket secured by lag screws 95 to the door header 17. The motor 22 and base plate 21 could be raised into position with the door operator 11 substantially horizontal and secured to the ceiling 18 by any suitable mounting support 28. The carriage 25 would already be in place on the guide rail means 23, and would be slid to about the position shown in full lines in FIG. 1. The link 26 would be fastened to the carriage 25 by the pivot pin 82 and the bracket 84 with the pivot pin 83 therein would be secured to the upper part of the door 12.

A down limit switch 97 and an up limit switch 98 would be slid along the guide rail means 23 to suitable positions to de-energize the motor 22 upon the carriage 25 reaching the closed and fully open positions, respectively. The electrical circuit may be the same as on the typical screw drive or chain drive operator. If the slide block 70 was not interlocked with the carriage 25, it could be interlocked in either of two ways. The door 12 could be actuated manually until the carriage 25 was moved to the position of the slide block 70, and as it approached, the latch 87 would ride along one of the ramps 75 or 76 to be cammed downwardly against the urging of the spring 89 and then the spring would force the latch into the recess 77 to interlock the slide block 70 and the carriage 25. Alternatively, the motor 22 could be energized and the tape moved within the guide rail means 23 to have the slide block 70 approach the carriage 25. At the final approach, the ramp surface 75 or 76 would depress the latch 87 and then the spring 89 would cause the latch to engage the recess 77, to complete this interlocking.

Figure 7:
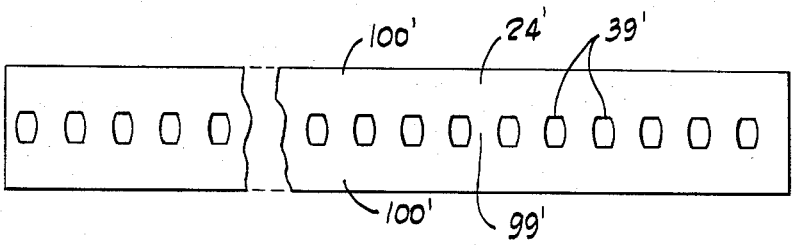
Fig. 7 PRIOR ART
FIG. 7 is an enlarged plan view of part of a prior art flexible tape.
Figure 8:
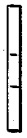
Fig. 8 PRIOR ART
FIG. 8 is an end view of the tape of FIG. 7.
Figure 9:
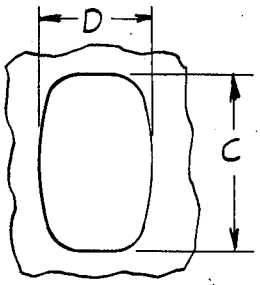
Fig. 9 PRIOR ART
FIG. 9 is a greatly enlarged detail of the aperture in the prior art tape of FIG. 7.
Figure 10:
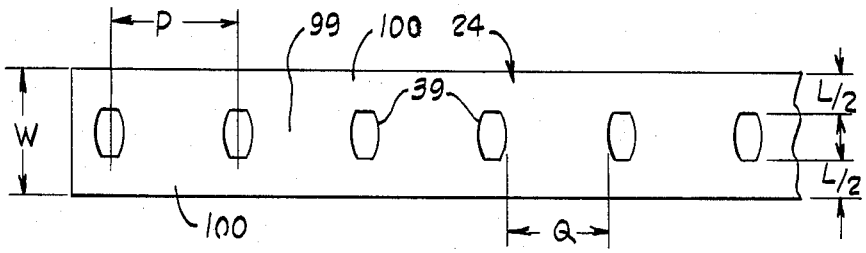
FIG. 10 is an enlarged plan view of a part of the flexible tape of the invention to the same scale as FIG. 7.
Figure 11:
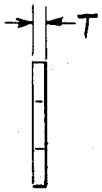
FIG. 11 is an end view of the tape of FIG. 10.
Figure 12:
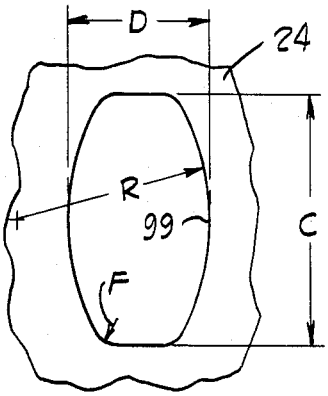
FIG. 12 is a greatly enlarged detail of the aperture in the flexible tape of the invention to the same scale as FIG. 9.

FIGS. 7, 8, and 9 show a prior art form of flexible tape 24 which was commercially available, and FIGS. 10, 11, and 12 show similar views of the flexible tape 24 of the present invention. In the prior art tape 24 of FIGS. 7–9, the tape apertures 39′ were smaller, and the pitch was smaller, so that the holes were spaced closer together. The tape 24 of the present invention has a plurality of longitudinally aligned apertures 39 to cooperate with the teeth 38 on the drive sprocket 29. In the preferred embodiment, all of the apertures 39 are longitudinally aligned and on the central axis of such tape 24.

The prior art tape shown in FIGS. 7–9 was apparently satisfactory for light duty such as raising and lowering windows in an automobile body, and may have been initially satisfactory for a sectional type of upward acting garage door operator. However, not all garage doors are easy to open. The two types of one-piece or slab doors mentioned above, with one type shown in FIG. 1, are often difficult to operate. Usually, there is one position in the opening movement where the drive force is a maximum. This may be at the starting position, or at an intermediate position, as is the case with the slab door shown. Such maximum force may exceed 100 pounds in many instances, especially where the door is poorly counterbalanced from being waterlogged, for example, or is sticking in the door frame 16.

TABLE A

| | W | T | C (in inches) | D | Q | W − C / L | P | R | F | Area in square inches ~C.D. | W − C / Q | W − C / C | Web Shear Strength | Aperture Percent Area |
|---|---|---|---|---|---|---|---|---|---|---|---|---|---|---|
| FIGS. 7–9 | 13/16 | .081 | .230 | .150 | .168 | .5825 | .318 | .320 | .040 | .0304 | 3.467 | 2.532 | 370 psi | 11.75% |
| FIGS. 10–12 | .791 / .807 | .082 | .330 | .190 | .658 | .470 | .848 | .320 | .031 | .0528 | .714 | 1.424 | 600 psi | 7.78% |

It will be observed that each time the door is moved in its opening direction from the fully closed position, the drive sprocket teeth 38 are always in engagement with the very same apertures 39 in the tape 24 at the area of maximum force requirement. The tape is flexible and is an elastomeric tape, namely, it has some elasticity. It has been observed that the tape begins to stretch at the first aperture of this maximum force requirement area, which would be at about the six o'clock position in FIG. 4. This slight stretching causes the web 99', between successive apertures 39', to be thickened and deformed toward the next adjacent aperture 39. This slight stretching is of the two tension bands 100', one on either side of the longitudinal row of apertures. If the flexible tape 24 were non-elastic, such as a link chain, for example, then each of the teeth of the sprocket wheel would transmit approximately equal loads to the tape. However, in view of the fact that the tape begins to stretch under very heavy loads, the first web 99' at about the six o'clock position of FIG. 4 carries the greatest load. It has been found during life tests that the prior art tape of FIGS. 7–9 will strip out all of the webs 99' between the apertures, and hence the tape will fail.

The present invention solves this problem by more nearly equalizing the shear strength of the various webs 99 to that of the tensile strength of the two tension bands 100 laterally adjacent the row of apertures 39. In the present invention shown in FIGS. 10–12, the width and thickness of the tape remain approximately the same, yet the loading from each individual tooth onto the tape has been decreased because the width C of the apertures has been increased materially. This slightly weakens the tension bands to the point where the shear strength of the webs 99 more nearly approximates the tensile strength of such tension bands 100. The apertures 99 are larger but fewer in number, and this materially strengthens the webs 99.

A typical property of the EPS elastomeric polyester tape sold by E. I. DuPont de Nemours & Company is one wherein the tensile strength is 30,000 psi and the web breakload is 370 pounds in a tensile loading machine. A sample is fixed in this tensile loading machine with four apertures on each end engaged with the teeth of the test fixture, which teeth duplicate the geometry of the apertures in the tape. The sample is loaded at a speed of 500 mm. per minute until the web between the apertures breaks and the load falls off.

Table A shows the various dimensions in inches and ratios for the prior art tape of FIGS. 7–9 relative to the tape of the present invention shown in FIGS. 10–12. The width and thickness are practically the same, except that in the present invention the holes are nearly fifty percent wider but there are fewer of them. This greater width of the apertures 39 means that the loading on the tape at the tooth face is considerably lessened, so that the tape is able to establish a greater pulling force on the door.

It will be noted that in the prior art tape, the ratio of the width of the tape remaining adjacent an aperture to the longitudinal distance between successive longitudinally aligned apertures is 3.467, whereas in the tape of the present invention, this ratio is only 0.714. Therefore, even though the holes are larger and narrow the tension bands on either side of the row of apertures, the webs 99 are greatly strengthened and the tape has about an 89% increase in strength. Even though each aperture is wider and longer to have a larger area, the apertures are spaced farther apart so that the area of the apertures relative to the area of the tape is actually decreased about 4% for about 4% more tape material; however, the strength is increased about 89%. Also, Table A shows that the width of the tape remaining adjacent an aperture (shown as W-C) has a ratio relative to the width of the aperture of less than 2:1 in the present invention. In the prior art, this ratio is 2.532, and in the present invention, this ratio is 1.424.

From FIGS. 7–12, it will be noted that the tension forces in the belt are borne by at least one longitudinal belt area 100 disposed laterally of the longitudinally aligned apertures 39. In FIGS. 10–12, there are two such longitudinal belt areas, one on either side of the centrally aligned apertures. The present invention contemplates a method of determining the tensile strength of such belt in the at least one longitudinal belt area, and further determines the shear strength of the belt between the webs 99 and the longitudinal belt area 100, and then adjusting the size and spacing of the apertures to make these two strengths more nearly equal.

The assembled door operator 11 is one which has the guide rail means 23 adapted to be installed so that this guide rail is parallel to at least part of the movement of the garage door 12. As illustrated in FIG. 1, this is a horizontally disposed guide rail, with a part of the door movement being substantially horizontal. The flexible tape 24 may be a continuous tape, but is shown as being discontinuous, having first and second ends 74 and 66. This achieves an economy in the amount of tape used, which is possible because the tape may have a thickness of about 0.082 inch and a width of about 0.800 inch, so that even with the apertures 39, it has sufficient tensile and compressive strength for opening and closing movements, respectively, of the door 12. The door may have a weight of several hundred pounds and may have an unbalanced or non-counterbalanced weight of 50, or even 100, pounds. It has been determined that this flexible tape 24, when loaded in tension for opening movements, and loaded in compression for closing movements, is satisfactory to establish such door movements. A further advantage is the inherent safety of the door operator. The tape 24 will withstand about twice as much stress in tension as in compression while sliding in the guide rail 23. The typical garage door requires about twice as much upward opening force as downward closing force, so this tape 24 is very closely matched to these requirements and also inherent safety is achieved because one prefers limited down force so as not to crush an object or person. The tape is relatively noise-free without lubrication, which is another advantage. The tape will withstand bending around a 1.75 inch diameter drive sprocket 29 despite variations of temperature from −10° F. to 120° F. and be self-lubricating in the guide channels 59 and 60.

The slide block 70 extends through the lower slot 63 in the guide rail lower flange 56, so as to engage the tape 24. Since the tape covers the majority of this elongated slot 63 on the lower side of the lower flange 56 and since this elongated slot is on the lower side of the lower flange, dust and other contaminants do not readily enter the first guide channel 59, making the use of a greasy lubricant unnecessary to thus inhibit entrance of any grit or other abrasive particles which might limit the life of the tape 24 within this guide channel 59. Thus, an economical yet long-life door operator 11 is achieved. The slots 41 and 42 in the guide channels 59 and 60 may have a clearance of only about 0.002 to 0.008 inch relative to the flexible tape 24. This means that the tape will be closely enveloped and guided both on the two flat sides thereof and on the two edges thereof, so that the tape has a minimum opportunity to buckle when loaded in compression, i.e., for the closing direction of movement of the door 12.

The tape at 23 degrees Centigrade has a stiffness of 125,000 psi, with a 50 mm. span, a 6° deflection, and a 0.113 Newton-meter load. This stiffness inhibits the tendency to buckle within the guide rail 23, yet it will be observed that the more the door approaches the fully closed position, the longer the dimension of tape disposed within the lower guide channel 59. Accordingly, there is more length of tape subject to possible buckling, and hence the closing force on the door decreases progressively as the door approaches the fully closed position. This tendency, plus the friction brake 48 on the rotor 22, effectively defeats any attempt to open the garage door from the outside, e.g., by pushing inwardly at the top of the door.

The tape 24 is stored at all times within the door operator, namely, the guide channels 59 and 60, which prevents dust and dirt from getting on the tape, which could cause contamination and abrasive wear of the tape and guide channels.

From FIG. 4, it will be observed that the first and second guide channels 59 and 60 are spaced apart a distance less than the diameter of the drive wheel 29. This assures that the tape 24 extends around the circumference of the drive wheel 29 a distance greater than 180 degrees for a satisfactory, positive drive of the tape by the drive wheel 29.

The lower flange 56 performs three functions: it houses the first guide channel 59 for the first run 43 of the tape 24; it houses the second guide channel 60 for the second run 44 of tape 24; and it provides the longitudinal guide for the carriage 25. The tape 24 has the size and spacing of the apertures so adjusted relative to the longitudinal belt areas 100 that the shear strength of the webs 99 between the longitudinally adjacent active tooth apertures approaches the tensile strength of the tape, namely, that of the two longitudinal belt areas. The result is a door operator which has satisfactory economy, which utilizes a short shipping package, which is readily installed by a homeowner, and which has a satisfactory long life and strength for all readily available garage doors.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A motor-driven closure operator having a flexible tape with a plurality of longitudinally aligned apertures to mesh with teeth on a motor-driven drive member, said flexible tape adapted to be stressed longitudinally by movement of the drive member to actuate a closure, the improvement comprising:

means establishing the spacing and size of the apertures in said flexible tape in accordance with the number of active teeth on the drive member engaging the tape to establish the shear strength of the webs between longitudinally adjacent active tooth apertures approaching the tensile strength of the tape at an aperture.

2. A closure operator as set forth in claim 1, wherein the said shear strength is approximately equal to the said tensile strength.

3. A closure operator as set forth in claim 1, wherein said drive member is a rotatable drive sprocket, and said tape engages in excess of 180 degrees of the periphery of said drive sprocket with a maximum of five active teeth on said sprocket engaging said tape at said apertures.

4. A closure operator as set forth in claim 1, wherein the total width of the tape remaining adjacent an aperture is less than twice the width of the aperture.

5. A closure operator as set forth in claim 1, wherein the total width of the tape remaining adjacent an aperture is substantially seventy percent of the longitudinal distance between longitudinally adjacent apertures.

6. A closure operator as set forth in claim 1, wherein the total width of the tape remaining adjacent an aperture is less than twice the longitudinal dimension between longitudinally adjacent apertures.

7. A closure operator as set forth in claim 1, wherein the total width of the tape remaining adjacent an aperture is less than the longitudinal dimension between longitudinally adjacent apertures.

8. A closure operator having a motor-driven drive sprocket around part of which is disposed a flexible tape having a plurality of longitudinally aligned apertures, said flexible tape adapted to be stressed longitudinally by both forward and reverse rotation of the drive sprocket to actuate a closure, the improvement comprising: means establishing the spacing and size of the apertures in said flexible tape such that the ratio of the total width of the tape remaining at an aperture to the longitudinal distance between successive longitudinally aligned apertures is substantially 1:1.4.

9. A closure operator as set forth in claim 8, wherein the total width of the tape remaining at an aperture relative to the width of the aperture is less than 2:1.

10. The method of increasing the load capacity of a flexible elastic belt having a plurality of longitudinally aligned and spaced apertures therein for engagement with teeth of a sprocket wheel, said flexible elastic belt having at least one longitudinal belt area disposed laterally of said longitudinally aligned apertures and having web areas disposed between successive longitudinally aligned apertures, said method comprising: determining the tensile strength of said flexible elastic belt in said at least one longitudinal belt area; determining the shear strength of said flexible elastic belt between said web and said at least one longitudinal belt area; and adjusting the size and spacing of said apertures to make said two strengths more nearly equal.

11. The method as set forth in claim 10, wherein all of said apertures are longitudinally aligned.

12. The method as set forth in claim 11, wherein two longitudinal belt areas are established on opposite sides of said plurality of apertures.

* * * * *